United States Patent [19]

Yoshioka et al.

[11] 4,264,536

[45] Apr. 28, 1981

[54] ADJUSTING DEVICE FOR STARTER-EQUIPPED CARBURETOR

[75] Inventors: Yuichi Yoshioka, Sayama; Toshio Nomura; Takenobu Kojima, both of Niiza, all of Japan

[73] Assignee: Honda Giken Kogyo Kabushiki Kaisha, Tokyo, Japan

[21] Appl. No.: 68,199

[22] Filed: Aug. 17, 1979

[30] Foreign Application Priority Data

Oct. 19, 1978 [JP] Japan ..... 53-128774

[51] Int. Cl.[3] ..... F02M 1/06

[52] U.S. Cl. ..... 261/39 D; 261/121 B; 123/180 T; 123/187.5 R

[58] Field of Search ..... 261/39 D, 121 B; 123/180 T, 187.5 R

[56] References Cited

U.S. PATENT DOCUMENTS

| | | | |
|---|---|---|---|
| 1,619,612 | 3/1927 | Grudzinski | 261/39 D |
| 2,675,792 | 4/1954 | Brown et al. | 261/39 D |
| 2,868,185 | 1/1959 | Bellicardi | 261/39 D |
| 3,695,591 | 10/1972 | Caisley | 261/39 D |
| 3,764,120 | 10/1973 | Imai | 261/121 B |
| 4,180,533 | 12/1979 | Bonse | 261/39D |

FOREIGN PATENT DOCUMENTS

| | | | |
|---|---|---|---|
| 2820886 | 11/1978 | Fed. Rep. of Germany | 261/39 D |
| 2852403 | 6/1979 | Fed. Rep. of Germany | 261/39 D |

*Primary Examiner*—Tim R. Miles
*Attorney, Agent, or Firm*—Haseltine and Lake

[57] ABSTRACT

A carburetor equipped with a starter, having a starting mixture supplying passage, and an automatic starting mixture adjusting device. The starting air supplying passage merges into the starting mixture supplying passage and a starting piston is provided at the opening where such passages are merged in each other. There is a heat-sensitive body disposed at a position where it can receive heat from an engine, such that the starting piston is displaced by a displacement or deflection of the heat-sensitive body for adjustment of the degree of opening to adjust the amount of mixture introduced into the intake passage of the carburetor and the air fuel ratio of the mixture.

2 Claims, 2 Drawing Figures

ADJUSTING DEVICE FOR STARTER-EQUIPPED CARBURETOR

BACKGROUND OF THE INVENTION

The present invention relates to an automatic adjusting device for automatically adjusting the starting mixture formed by a carburetor equipped with a starter.

A typical carburetor of the kind described has a starting mixture supplying passage adapted to be opened and closed by a starting piston. In this type of carburetor, adjustment is possible only for the amount of starting mixture. In addition, in order to prevent the mixture from becoming excessively rich under operation of the starter immediately after the start of engine, the starting mixture supplying system is set to satisfy the air-fuel ratio demanded by the engine only in a specific range of the air-fuel ratio. Furthermore, the reduction of the intake vacuum which takes place when the throttle valve is closed quickly incurs a reduction of the vacuum in the starting mixture supplying passage, resulting in various inconveniences such as reduction of sucking of starting fuel, insufficient following-up of the change in temperature of ambient air and other problems which make the response to the engine demand insufficient.

SUMMARY OF THE INVENTION

It is therefore the main object of the invention to provide an automatic starting mixture adjusting device which can automatically respond to the air-fuel ratio demanded of the engine, to thereby obviate above stated problems of the prior art.

To this end, according to the invention, there is provided an automatic starting mixture adjusting device having a heat-sensitive body disposed at a position where it can detect the temperature of the engine, such as the temperature at the cylinder head, i.e. at a position where it can detect the level of the air-fuel ratio demanded by the engine. The starting mixture is automatically adjusted by making use of the movement of the heat-sensitive body at the moment of the engine start and a period immediately after the engine start, to automatically comply with the air-fuel ratio demand of the engine.

The invention will be best understood with respect to the accompanying specification, claims and drawings, in which:

DESCRIPTION OF THE PREFERRED EMBODIMENTS

The invention will be fully described hereinunder with reference to the accompanying drawings.

Figure 1:
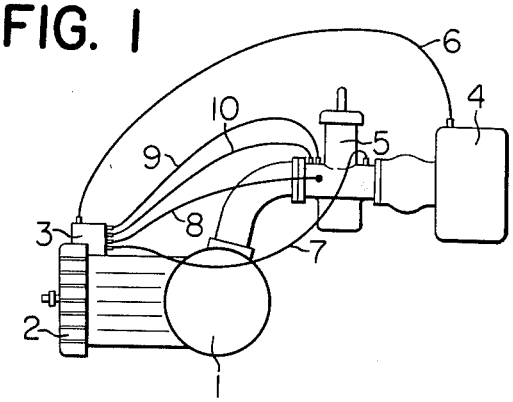
FIG. 1 is a schematic illustration of a fuel supplying system provided with an automatic starting mixture adjusting device of the invention.

Referring first to FIG. 1, an internal combustion engine which may be a 2-cycle engine is generally designated at a reference numeral 1. A starting mixture adjusting unit 3, which will be described hereinafter, is mounted on the engine 1 at a portion of the latter where it can detect the engine temperature. The unit 3 is connected to an air cleaner 4 and also to a portion of a starter-equipped carburetor 5 upstream of the throttle valve, through air supplying pipes 6 and 7, respectively.

The unit 3 is connected also to a starting mixture supplying passage of the carburetor 5 through a mixture supplying pipe 8. The unit 3 is connected to the portion of the intake passage of the carburetor 5 downstream from the throttle valve, through a mixture delivery pipe 9 and a vacuum application pipe 10.

Figure 2:
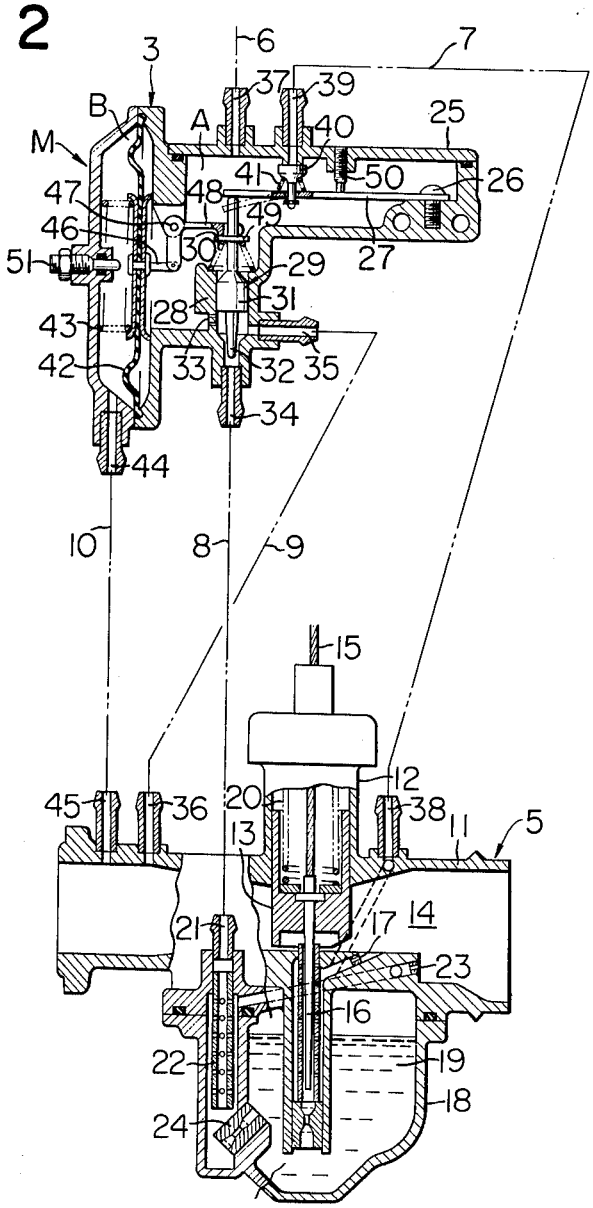
FIG. 2 is a sectional view of an embodiment of the invention.

FIG. 2 shows how the carburetor 5 is associated with unit 3. The carburetor 5 is provided with a piston type throttle valve 13 which is slidably received by a throttle valve guide sleeve 12 provided at the upper portion of the intake barrel 11. The lower portion of the throttle valve 13 faces an intake passage 14 formed in the intake barrel 11. An operation wire 15 is fixed to the throttle valve 13. The arrangement is such that the throttle valve 13 is lifted to open the intake passage 14 as the operation wire 15 is pulled, so that a needle valve 16 integral with the throttle valve 13 is lifted to allow the fuel 19 in a fuel well 18 together with the air induced through a main bleed port 17. The fuel and air thus sucked are then induced into the engine. As the operation wire is relieved, the throttle valve 13 is returned by the force of a spring 20 to reduce the opening degree of the intake passage 14 to a predetermined idling opening.

A starting mixture supplying passage 21 is formed in the side wall of the carburetor 5. The starting mixture supplying passage 21 accommodates a bleed pipe 22. A starting bleed port 23 opening to the portion of the intake passage 14 upstream from the throttle valve is communicated with the passage 21. The passage 21 is further communicated at its lower portion with the fuel well 18 through a starting orifice 24.

The starting mixture adjusting unit 3 has a casing 25 in which a heat-sensitive body is disposed. In the illustrated embodiment, the heat-sensitive body is a bimetal 27 fastened at its one end to the inside of the casing by means of a small screw 26.

A starting piston 29 is slidably received by a cylinder 28. The upper end of the starting piston 29 is kept in contact with the surface of the lower free end surface of the bimetal 27 by means of a coiled spring 30. The starting piston 29 has a main body 31 adapted to slide within the cylinder 28 and a neelde valve attached to the lower end of the main body 31. The arrangement is such that the opening of a small port or slit for passing air formed at the lower end portion of the cylinder 28 is adjusted by the main body 31, while the opening of a mixture supplying port 34 is adjusted by the needle valve 32. The mixture supplying port 34 communicates with the starting fuel supplying passage 21 of the carburetor 5 through the mixture supplying pipe 8. A mixture delivery port 35 which extends at a right angle to the needle valve 32 of the starting piston 29 communicates with a mixture jetting port 36 disposed at a downstream side portion of the carburetor 5 through the mixture delivery pipe 9. A first air supply port 37 formed at an upper portion of the unit casing 25 is connected to an air cleaner 4 by means of an air supplying pipe 6.

The main bleed port 17 is provided with a bypass 38 which communicates with a second air supplying port by means of the air supplying pipe 7.

A valve 40 attached to the bimetal 27 is kept in pressure contact with the inner brim of the second air supplying port 39 by the force of a coiled spring 41.

A vacuum motor M is disposed in the unit casing 25 at one side of the latter. The vacuum motor is provided with a diaphragm 42 which separates the casing 25 into an atmospheric chamber A and a vacuum chamber B, and a spring 43 for resetting the diaphragm 42.

A vacuum application port 44 adapted for making damping action is in the vacuum chamber B, and communicates with a vacuum application port 45 disposed at the downstream side of the throttle valve in the intake passage 14 of the carburetor 5, by means of a vacuum application pipe 10. A shaft 46 fixed to the diaphragm 42 of the vacuum motor M, has a projecting end which is rotatably supported by one end of the bell crank 48 that is swingably mounted in the unit casing 25 by a shaft 47. The bell crank 48 abuts a flange 49 at its other end formed on the starting piston 29.

Reference numerals 50 and 51 denote, respectively, a stopper for the bimetal 27 and an adjustable stopper for the diaphragm 42.

In the above-described construction, when the engine has been sufficiently warmed up, the bimetal 27 deflects downward as shown by chain line to depress the starting piston 29, to thereby close the small port 33 for passing air. At the same time, the mixture supplying port 34 is closed by the needle valve 32 so that the supply of the starting mixture is interrupted.

To the contrary, when the engine is in the cold state, the bimetal 27 is deflected upward so that the starting piston 29 is lifted by the force of the coiled spring 30 to allow the small port 33 for air and the mixture supplying port 34 to open to predetermined openings.

Then the mixture constituted by the fuel and air which has passed the starting bleed port 24 and the starting orifice 24, is introduced to the mixture supplying passage 21 and the mixture supplying pipe 8. The metering is effected by the tapered shape of the needle valve 32 of the starting piston 29 to provide a mixture of an amount which meets engine demand. At the same time, starting air is metered in accordance with the degree of opening of the small port 33 afforded by the main body 31 of the starting piston 29. It will be seen that the amount of the starting air and the air fuel ratio are adjusted in accordance with the engine temperature, i.e. through the deflection of the bimetal.

The starting mixture thus adequately adjusted is delivered through the mixture delivery port 35 and the mixture delivery pipe 9 to the mixture jetting port 36 of the carburetor body 5 to be jetted therefrom and induced into the engine.

In the period immediately after the start of the engine, the actual air-fuel ratio of the mixture sucked by the engine is rendered excessively rich over the engine demand, as the engine temperature is raised gradually. This phenomenon adversely affects the wetness of the ignition plug and optimum combustion.

According to the invention, the intake vacuum established immediately after the start of the engine is introduced into the vacuum chamber B, through the vacuum application port 45 downstream from the throttle valve, vacuum application pipe 10 and through the vacuum application port 44 of the vacuum motor M. The pulsation of the vacuum pressure is conveniently attenuated as the latter is transmitted through the vacuum application port 44. As the force exerted by the vacuum comes to exceed the force of the reset spring 43, the diaphragm 42 is sucked and deflected to the left as viewed in the drawing. This deflecting force is transmitted to the bell crank 48 through the shaft 46. Consequently, the bell crank 48 is rotated clockwise around the shaft 47 to depress the starting piston 29 by a distance corresponding to the level of the vacuum, so that the amount of the starting air and the air-fuel ratio which have been adjusted by the action of the bimetal 27 are effectively corrected to prevent the mixture from becoming excessively rich after the start of the engine.

Ordinary starter-equipped carburetors are so designed and set to smooth the cold start of the engine at a fixed cold temperature. It is extremely difficult to make the carburetor comply with the air-fuel ratio demanded by the engine over a wide range of engine temperature including a temperature below the above-mentioned fixed cold temperature.

To overcome this problem, according to the invention, the passage for supplying starting air to the unit 3 has two lines: a line leading from the air cleaner 4 and another line leading from the bypass 38 of the main bleed port 17. When the engine temperature is low, e.g. below 40° C., the bimetal 27 is deflected to make the valve 40 close the second air supplying port 39 so that a richer mixture may be induced into the engine, thereby to facilitate the starting of the engine and to smoothen the running of the automobile until the engine is sufficiently warmed up.

BEST MODE OF INVENTION

A carburetor 5 for use with an engine 1 is equipped with a starter, having a starting mixture supplying passage, and an automatic starting mixture adjusting device 3 has an air supply passage for starting which merges into said starting mixture supplying passage 21. A starting piston 29 is provided at the opening where said passages merge to one another; a heat-sensitive bimetal body 27 is disposed at a position where it receives heat from the engine 1 and the starting piston 29 is adapted to be displaced by a displacement or deflection of said heat-sensitive body 27 to thereby adjust the degree of opening and govern the amount of mixture introduced into intake passage 14 of said carburetor 5 and the air fuel ratio of the mixture.

As will be seen from the foregoing description, according to the invention, it is possible to automatically adjust the amount and air-fuel ratio of the mixture to meet the engine demand at the time of start up of the engine and in the period immediately after the start up of the engine. Consequently, the engine is started smoothly under various circumstances and can operate stably once it is started.

Many modifications and variations of the present invention are possible in light of the above teachings. It is, therefore, to be understood that within the scope of the appended claims, the invention may be practiced otherwise than as particularly described.

What is claimed is:

1. An automatic starting mixture adjusting device for use with an engine equipped with a starter having a carburetor being formed as a unit separate from the carburetor proper and being mounted on the engine at a location for detecting engine temperature, said device comprising: a starting mixture supply passage, a starting air supply passage merging into said starting mixture supply passage, a heat-sensitive body disposed on the engine at a position where it receives heat from the engine, a starting piston slidable in a bore into which said passages open, and having a main body and a needle valve attached to the end of said main body, said starting piston being displaceable by a displacement of said heat-sensitive body, to thereby adjust both the degree of opening of said air supply passage by said main body and the degree of opening of said starting mixture supply passage by said needle valve, to govern the respective amounts of air and mixture introduced into an intake passage of said carburetor for fine adjustment of air-fuel ratio of mixture, and a vacuum motor operatively connected with said starting piston being actuatable by an intake vacuum established immediately after the starting of said engine, for readjusting and correcting both the amount and the air fuel ratio of mixture previously adjusted by said starting piston.

2. An automatic starting mixture adjusting device according to claim 1, wherein: said starting air supply passage comprises a primary passage communicating with atmosphere and a secondary passage communicating with a main bleed port of said carburetor, said secondary passage being closed through displacement of said heat-sensitive body when engine temperature is below a predetermined temperature.

* * * * *